US007066681B2

(12) United States Patent
Paske

(10) Patent No.: US 7,066,681 B2
(45) Date of Patent: Jun. 27, 2006

(54) SHAFT ASSEMBLY FOR A VIBRATORY ROLLER

(75) Inventor: Benjamin J. Paske, Slinger, WI (US)

(73) Assignee: M-B-W Inc., Slinger, WI (US)

( * ) Notice: Subject to any disclaimer, the term of this patent is extended or adjusted under 35 U.S.C. 154(b) by 0 days.

(21) Appl. No.: 10/990,788

(22) Filed: Nov. 17, 2004

(65) Prior Publication Data

US 2006/0104718 A1 May 18, 2006

(51) Int. Cl.
*E01C 19/38* (2006.01)

(52) U.S. Cl. ..... 404/117; 74/86

(58) Field of Classification Search ..... 404/103, 404/113, 117, 130; 74/86, 87
See application file for complete search history.

(56) References Cited

U.S. PATENT DOCUMENTS 3,656,419 A * 4/1972 Boone ..... 404/117
4,194,405 A * 3/1980 Reynolds ..... 74/87
4,319,857 A * 3/1982 Reynolds ..... 404/117
4,749,305 A 6/1988 Brown et al.
5,062,228 A 11/1991 Artzberger
6,234,718 B1 5/2001 Moffitt et al.
6,585,450 B1 * 7/2003 Meyers et al. ..... 404/117
6,637,280 B1 10/2003 Potts

OTHER PUBLICATIONS

ROLLERS Solutions that Last; MBW Inc. company brochure; L16485, Mar. 2004.

* cited by examiner

*Primary Examiner*—Thomas B. Will
*Assistant Examiner*—Alexandra Pechhold
(74) *Attorney, Agent, or Firm*—Andrus, Sceales, Starke & Sawall, LLP

(57) ABSTRACT

An eccentric shaft assembly for a vibratory roller utilizes a cylindrical tubular shaft that considerably reduces the weight of the assembly, decreases substantially oscillatory shaft deflection during rotation and thereby improves bearing and seal life. The eccentric weights are mounted on the interior of the tubular shaft, thereby simplifying manufacture and providing a smoother operation.

9 Claims, 2 Drawing Sheets

SHAFT ASSEMBLY FOR A VIBRATORY ROLLER

BACKGROUND OF THE INVENTION

The present invention pertains to vibratory rollers for soil and backfill compaction and, more particularly, to an improved shaft assembly for a vibratory roller.

Vibratory rollers are well known in the utility and road construction industries for compacting backfill and other fill materials. Typically, such rollers include a large cylindrical roller drum attached to a piece of off-road equipment for movement over the surface to be compacted. A vibratory exciter shaft is mounted axially inside the drum, journaled to rotate independently of the drum and driven at high speed to impart vibratory motion to the drum to facilitate compaction. A vibratory roller may also be mounted with a scraper blade, such as shown in the apparatus of U.S. Pat. No. 5,062,228.

As shown in the above-identified patent and typical of the prior art, the exciter shaft comprises a solid steel shaft to opposite ends of which are welded aligned eccentric weights. It is also known to fasten the eccentric weights to the solid shaft with bolted connections. The opposite ends of the solid shaft are journaled in the end walls of the drum utilizing a bearing and seal arrangement. It has been found, however, that a solid steel eccentric shaft, having a typical diameter of about 3 inches (about 75 mm), is subject to excessive deflection at high speed rotation in the unsupported center of the shaft. This deflection is transmitted to the bearings and end seals, resulting in excessive misalignment, overheating, leakage and eventual failure of both the seals and bearings. Also, bolted connections are less reliable and more susceptible to failure then welds.

In accordance with the present invention, the prior art solid steel shaft is replaced by a hollow shaft of improved stiffness, yet lower weight, with an improved mounting for the eccentric weights and a lubrication system that is more effective and efficient.

SUMMARY OF THE INVENTION

The present invention is directed to a shaft assembly for a vibratory roller of the type having a roller drum enclosed by annular end walls on opposite axial ends of the drum, the shaft assembly comprising a cylindrical tubular shaft, eccentric weights mounted on the interior wall of the tubular shaft and equally distributed axially therewithin, a pair of shaft ends that enclose the opposite axial ends of the tubular shaft, each shaft end including a reduced diameter stub shaft that carries a bearing and seal journaled in the drum end wall for rotation relative thereto.

In the preferred embodiment, a tubular shell encloses the tubular shaft and is operatively attached at opposite ends to the end walls of the roller drum for rotation therewith. The tubular shell and the tubular shaft define a sealed annular oil chamber. In the preferred construction, each drum end wall has mounted centrally therein an end cap that surrounds one of the stub shafts and provides the journaled mounting for the bearing and seal. The end cap includes a cylindrical outer surface portion that is adapted to be received in a counterboard end of the tubular shell for attachment thereto. One of the stub shafts is provided with a drive connection for transmitting driving rotation to the tubular shaft.

In the preferred embodiment, the eccentric weights comprise a solid semi-cylindrical weight on each end of the interior of the tubular shaft adjacent the shaft ends, the weights positioned in axial alignment within the tubular shaft. Each of the eccentric weights has a diameter equal to the ID of the tubular shaft. Preferably, oil distribution elements are attached to the OD of the tubular shaft and oriented with respect to the direction of shaft rotation to direct oil in the oil chamber axially toward the bearings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
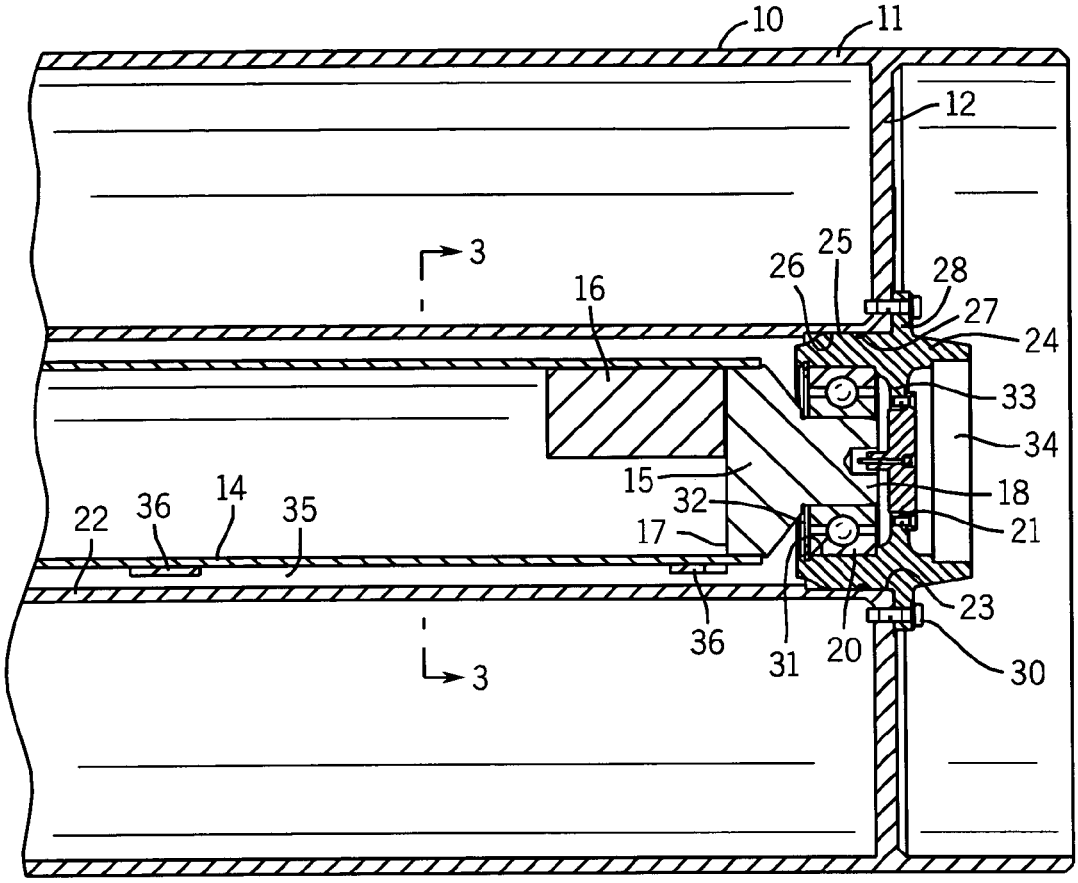
FIG. 1 is a perspective view, partly exploded and partly in section, showing the shaft assembly of the present invention.
Figure 3:
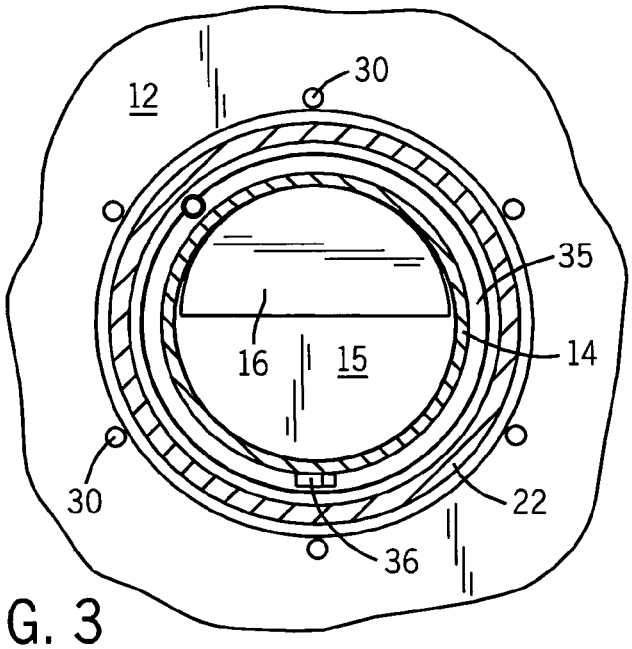
FIG. 3 is a sectional view taken on line 3—3 of FIG. 1.
Figure 2:
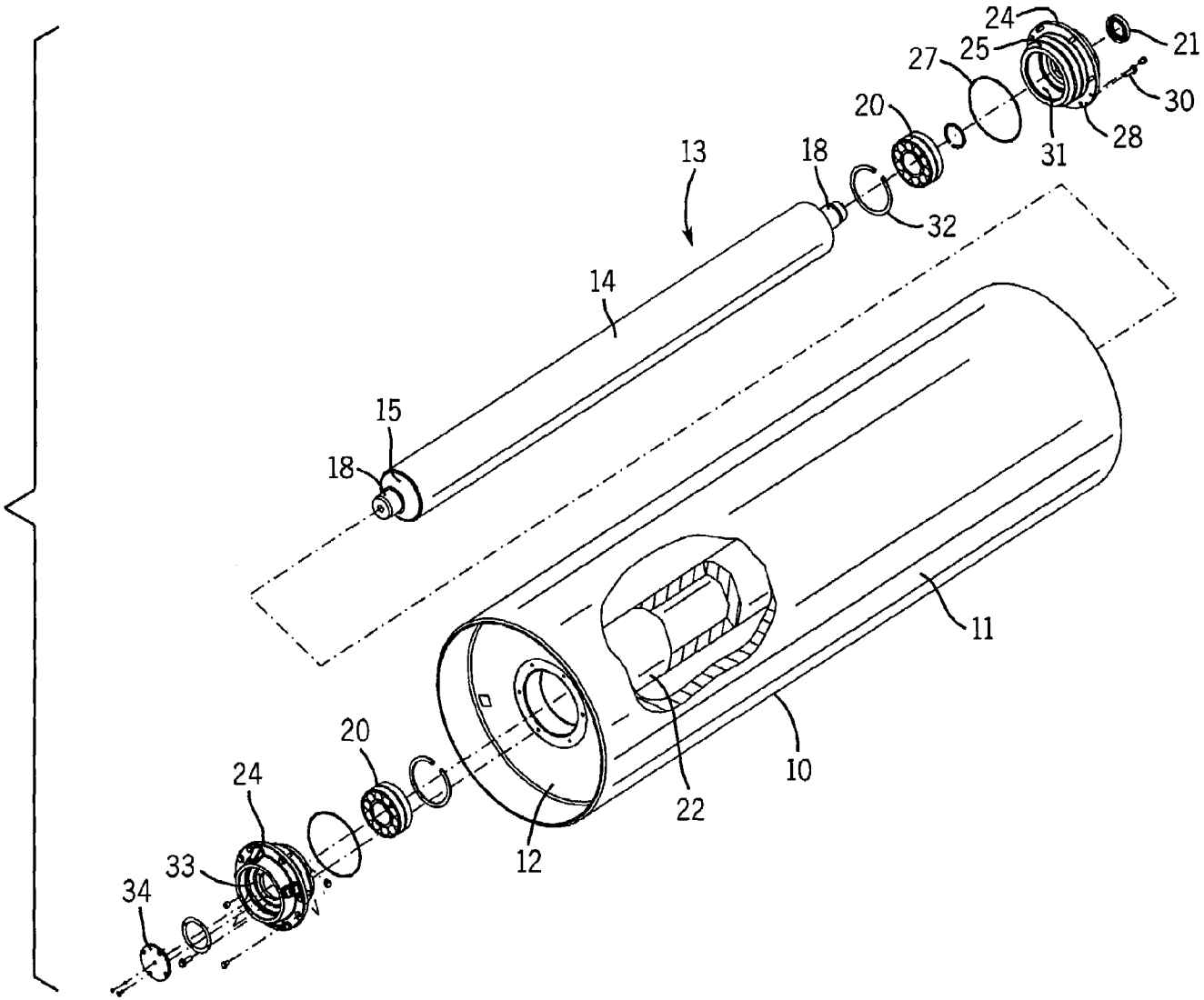
FIG. 2 is an enlarged sectional view through the drum of a vibratory roller showing the mounting of the shaft assembly of the present invention.

Referring to FIGS. 1 and 2, a roller drum 10 for a vibratory roller has a cylindrical outer wall 11 enclosed at opposite ends by annular end walls 12. An arrangement (not shown) for mounting the roller drum 10 to a carrying vehicle, such as a tractor, is connected to the end walls 12. Such a mounting arrangement is shown, for example, in above-identified U.S. Pat. No. 5,062,228 which is incorporated by reference herein.

A vibratory shaft assembly 13 of the present invention is mounted on the axis of the drum 10 between the end walls 12. The shaft assembly 13 includes a cylindrical tubular shaft 14 which, in one embodiment, is made from a steel tube having an OD of 6 inches (about 150 mm) and a wall thickness of 0.25 inch (about 6 mm). This thin wall tubular shaft 14 replaces the solid steel shaft used in the prior art, as shown in the above identified patent.

The opposite ends of the tubular shaft 14 are closed with a pair of shaft ends 15 which are machined from circular bar stock. The shaft ends 15 are welded to the ends of the tubular shaft 14, but prior to attachment, a semi-cylindrical eccentric weight 16 is welded to the ID of the tubular shaft at each end. Each eccentric weight 16 has a diameter that corresponds to the ID of the tubular shaft 14 and is positioned to lie immediately adjacent the inside face 17 of a shaft end 15. Each shaft end 15 includes a reduced diameter stub shaft 18 on which is mounted the inner race of a bearing 20 and the inner surface of a rotary seal 21.

The tubular shaft 14 is enclosed by a tubular shell 22 that is welded at opposite axial ends around the periphery of circular openings 23 in the drum end walls 12. The tubular shaft 14, including the shaft end 15, bearing 20 and seal 21, is mounted for rotation within the tubular shell 22 by an end cap 24. The mounting assembly to be described is essentially identical for both ends of the shaft assembly 13. Thus, each end cap 24 has a cylindrical outer surface 25 by which the end cap is received in a counterbore 26 in the end of the tubular shell 22. An O-ring seal 27 seats in a groove in the cylindrical outer surface 25 to prevent leakage of oil past the shell 22 and end cap 24 interface. Each end cap 24 also includes an outer mounting flange 28 by which the end cap is attached to the drum end wall 12 with a circular pattern of mounting bolts 30. The ID of the end cap 24 is provided with an inside counterbore 31 which receives the outer race of the bearing 20. The bearing is held in place with a retaining ring 32. The end cap also has an interior flange 33 that receives the outer face of the seal 21 which, in turn, is enclosed and held on the surface of the stub shaft 18 by a breather cap 34. The breather cap is used only on one axial end of shaft assembly, the end cap 24 at the opposite end being tapped for attachment of the drive pulley (not shown) or the like used to impart rotary motion to the tubular shaft 14.

Thus, the cylindrical tubular shaft 14 and eccentric weights 16 mounted therein are journaled by the shaft ends 15 for rotation inside and relative to the tubular shell 22. The thin annular space 35 between the OD of the tubular shaft 14 and the ID of the tubular shell 22 is partially filled with oil to provide lubrication for the bearings 20. The main seals 21 and O-ring seals 27 retain the oil within the annular space 35. Oil distribution elements 36 are welded to the OD of the tubular shaft 14 to assist in lubricating the bearings 20. The annular space 35 is filled with oil only to a depth of about ⅓ the diameter of the tubular shell 22. The oil distribution elements 36 comprise short lengths of bar stock or key stock and are oriented with respect to the direction of shaft rotation to direct oil in the annular space 35 toward the bearings 20.

In addition to the preferred embodiment described above, the tubular shaft 14 could be mounted in a manner in which it extends through the end walls 12 of the roller drum 10 and journaled for rotation relative to the drum on external bearings. The external bearings could be attached, for example, to the plate on the carrying vehicle which also mounts the drum 10 for rotation. Such a plate or "spider" is shown as item 16 in U.S. Pat. No. 5,062,228. With bearings mounted externally of the drum 10, the tubular shell 22 and the end caps 24 of the preferred embodiment may also be eliminated because an oil chamber for internal lubrication of the bearings would no longer be needed. Nevertheless, a fully functional alternative construction utilizing the hollow cylindrical shaft 14 and internally mounted eccentric weights 16 may still be used. With respect to the eccentric weights, instead of the two semi-cylindrical weights 16 welded to the interior of the tubular shaft 14, alternate constructions, such as a single piece of bar stock welded to the inner wall of the shaft, could also be used.

By replacing the solid steel shaft of the prior art with the tubular shaft 14 of the present invention, shaft deflection has been reduced considerably and, as a result seal movement and bearing misalignment are also reduced. In addition, the mounting of the eccentric weights 16 inside the tubular shaft 14 (rather than on the OD of the solid shaft of the prior art) minimizes the disturbance of oil in the oil chamber 35, thereby reducing foaming and maintaining lower operating temperatures in the oil. The vibratory shaft assembly 13 of the present invention provides a marked improvement in operation, a lighter weight assembly, and substantially improved bearing and seal life.

I claim:

1. A shaft assembly for a vibratory roller having a roller drum closed by annular end walls on opposite axial ends of the drum, said assembly comprising:

a cylindrical hollow tubular shaft having a uniformly thin wall;

eccentric weight means mounted on the interior wall of the tubular shaft and equally distributed axially within the tubular shaft;

a pair of shaft ends enclosing the opposite axial ends of the tubular shaft;

each shaft end including a stub shaft carrying a bearing and a seal and journaled in the drum end wall for rotation relative thereto; and a tubular shell enclosing the tubular shaft and operatively attached at opposite axial ends to the end walls for rotation therewith, the tubular shell and tubular shaft defining a sealed annular oil chamber.

2. The shaft assembly as set forth in claim 1 wherein each drum end wall has mounted centrally therein an end cap surrounding one of the stub shafts and providing the journaled mounting for the bearing and the seal.

3. The shaft assembly as set forth in claim 2 wherein the end cap includes a cylindrical outer surface portion adapted to be received in a counterbored end of the tubular shell.

4. The shaft assembly as set forth in claim 1 including a drive connection to one of the stub shafts for transmitting driving rotations to the tubular shaft.

5. The shaft assembly as set forth in claim 1 wherein the eccentric weight means comprises a solid semi-cylindrical weight on each end of the tubular shaft adjacent the shaft end, the weights positioned in axial alignment.

6. The shaft assembly as set forth in claim 5 wherein the diameter of the weights is equal to the inside diameter of the tubular shaft.

7. The shaft assembly as set forth in claim 1 including oil distribution elements attached to the outside diameter of the tubular shaft and oriented with respect to the direction of shaft rotation to direct oil in the oil chamber axially toward the bearings.

8. An eccentric shaft assembly for a vibratory roller having a cylindrical roller drum with enclosing end walls on axial opposite drum ends, said assembly comprising:

a cylindrical tubular shaft having axially aligned eccentric weights mounted adjacent the inner wall on opposite ends of the tubular shaft;

a pair of shaft ends enclosing the axial ends of the tubular shaft, each shaft end carrying a bearing and a seal;

an annular end cap mounted on each drum end wall and axially overlying a portion of a shaft end and receiving the bearing and seal to provide a journaled mounting of the tubular shaft for rotation relative to the drum; and, a tubular shell extending between the end caps and coaxilly enclosing the tubular shaft to define a sealed annular oil chamber.

9. The assembly as set forth in claim 8 wherein each shaft end comprises a cylindrical annular end surface positioned within and attached to an end of the tubular shaft; and, a reduced diameter stub shaft carrying the bearing and seal.

* * * * *